United States Patent [19]

Hopkins

[11] 4,139,336

[45] Feb. 13, 1979

[54] EXPANSIBLE CHAMBER APPARATUS WITH PAIRS OF CYLINDRICAL ROLLERS

[76] Inventor: Walter M. Hopkins, 1306 W. Glenoaks Blvd., Glendale, Calif. 91201

[21] Appl. No.: 816,320

[22] Filed: Jul. 18, 1977

[51] Int. Cl.[2] ..... F01C 1/00; F01C 19/08; F01C 21/08

[52] U.S. Cl. ..... 418/142; 418/209; 418/270; 417/486; 91/61; 92/61; 92/76; 74/25

[58] Field of Search ..... 418/58, 107, 108, 209, 418/225, 270, 142; 417/437, 481, 486; 91/61; 92/61, 76, 178; 74/25, 23; 123/18 R, 45 R, 8.45; 192/59

[56] References Cited

U.S. PATENT DOCUMENTS

| | | | |
|---|---|---|---|
| 1,535,464 | 4/1925 | Gurley | 418/209 |
| 1,762,418 | 6/1930 | Petersen | 418/225 |
| 1,866,761 | 7/1932 | Feverheerd | 418/225 |
| 2,299,254 | 10/1942 | Riney et al. | 92/178 |
| 3,606,795 | 9/1971 | Simons | 74/25 |
| 3,641,985 | 2/1972 | La Forge | 123/8.45 |

FOREIGN PATENT DOCUMENTS

| | | | |
|---|---|---|---|
| 486926 | 2/1918 | France | 418/108 |

*Primary Examiner*—John J. Vrablik
*Attorney, Agent, or Firm*—John E. Wagner; Jerry S. Seiler

[57] ABSTRACT

An apparatus having an alternately expanding and contracting chamber comprises at least one pair of cylindrical rollers each having an exterior surface in continuous rolling engagement with the surface of the other roller of the pair, the rollers being rotatable along parallel axes, and two parallel side walls, with each one of the rollers also being in continuous rolling engagement with one of the side walls. A third wall is opposite the rollers and joins the two side walls wherein the chamber is defined between these walls and the pair of rollers, and is enclosed.

37 Claims, 12 Drawing Figures

EXPANSIBLE CHAMBER APPARATUS WITH PAIRS OF CYLINDRICAL ROLLERS

BACKGROUND OF THE INVENTION

Alternately expanding and contracting chambers are well known in the art, which devices employ various forms of rings or sliding surfaces to achieve sealing between adjacent parts. Commonly known is the piston-type combustion engine employing a closed cylinder, in which a piston, coupled to a crankshaft and connecting rod, provides an alternately expanding and contracting chamber. Similarly, the well-known Wankel engine utilizes scraping edge seals between the rotating piston and chamber inner surfaces by which the gases are compressed and expanded. Obviously, such apparatus result in substantial friction between the contacting components thereby causing wear.

In an attempt to avoid these continually wearing seals or rings between moving parts, rotary engines have been proposed in U.S. Pat. Nos. 1,349,882 and 2,097,881. The earlier patent employs four elliptical pistons between which the narrow spaces are sealed by spring-actuated rollers. In the latter patent, four elliptical rollers are in contact to define a combustion chamber therebetween. The problem with the aforesaid designs is their limitation because of the number of pistons or rollers as well as their shapes. Precise synchronization is required between the rotating and non-cylindrical rotors or pistons which is a significant disadvantage in apparatus design, as well as limiting the compression ratio of the chamber.

SUMMARY OF THE INVENTION

The apparatus of the present invention utilizes at least one pair of rotating cylindrical members or rollers which are maintained in continuous rolling contact with one another and with two opposite side walls, and which walls are preferably adjustable so as to maintain contact with the respective rollers and force them to make contact with each other, thereby compensating for any wear. This contact between the rollers and the side walls, which is continuous and held firmly, and preferably substantially along the entire roller lengths, obviates the necessity of seals and at the same time minimizes frictional wear, thus, greatly increasing the longevity of the apparatus and reducing the incidence of repairs. The apparatus provides at least one alternately expanding and contracting chamber sealed and defined between the rollers and the housing means. The cavity may be used for treating gases, liquids or slurries. Thus, use of such apparatus may be for engines, pumps, motors, compressors, valves and other power transfer devices and the like. The apparatus is not only a significant improvement because of its relative simplicity of design and reduction in operating costs and repairs but is economically manufactured because of the small number of parts as compared to the devices that require rings, seals, valves, and attendant operating components. The apparatus of the invention also achieves improved economy of performance and maintenance because the rolling action of the rollers themselves which seal the chamber require no lubrication of the roller wall or the major portion of the cavity surfaces. Further, because of the reduction of individual parts in the apparatus, and because the chamber itself is defined between the end and side walls, and the rollers, substantial reduction in weight can be achieved. These as well as other advantages will be evident from the following detailed description.

DETAILED DESCRIPTION OF THE INVENTION

Figure 1:
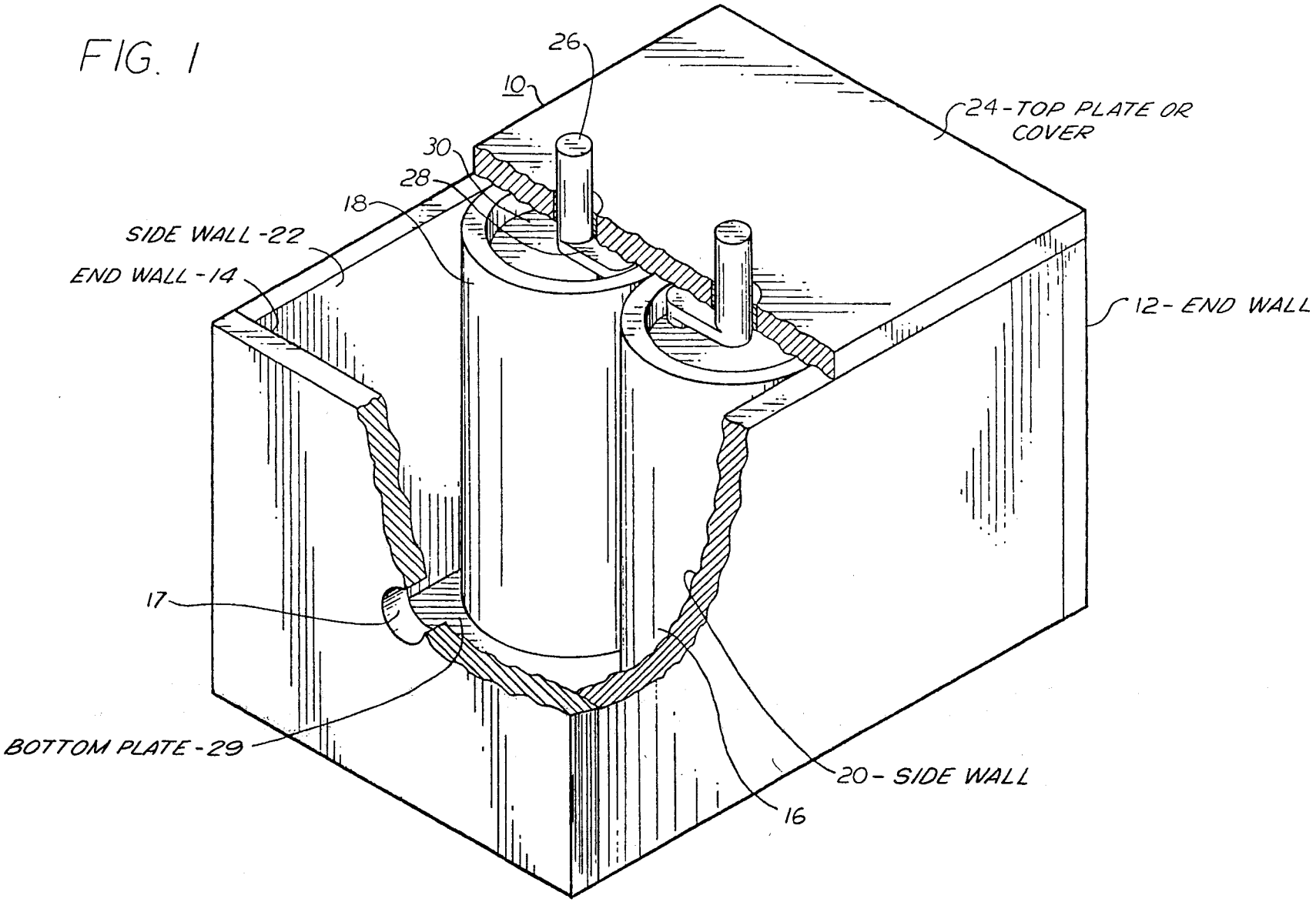
FIG. 1 is a perspective view, with an end plate and wall partially removed, illustrating the roller apparatus of the invention.
Figure 2:
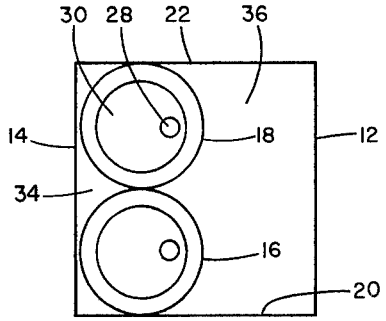
FIGS. 2–5 are top plan views showing different positions of the the rollers shown in FIG. 1 and chamber expansion and contraction resulting from rotating the rollers successively 90°.

Referring to FIG. 1, a pair of cylindrical rollers 16 and 18 are disposed in a jacket 10 having side walls 20 and 22 and end walls or panels 12 and 14. The two cylinders are maintained in rolling engagement along their surfaces as well as with the inner side wall surfaces. Preferably, the side walls are adjustable to compensate for wear of the cylindrical surfaces. Because of the continuous rolling engagement between the two cylinder surfaces, as well as between the cylinder surfaces and the respective interior side wall surfaces, there is formed a seal between those meeting surfaces which is maintained regardless of the position or location of the cylinders within the jacket.

Figure 3:
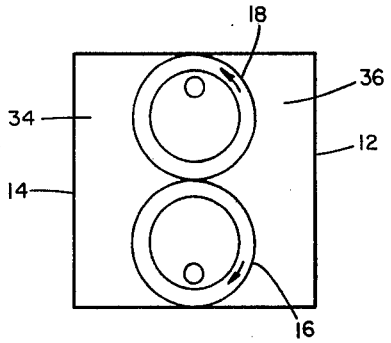
Figure 5:
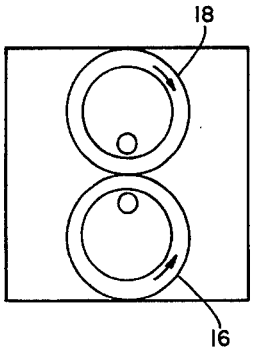
Figure 4:
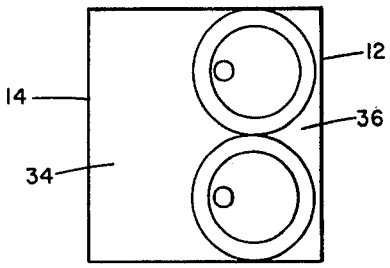

Obseving also FIGS. 2–5, as the rollers are driven within the hollow jacket cavity, the two chambers formed on each side of the cylinders are alternately and oppositely compressed and expanded. Thus, in FIG. 2, with the cylinders at their closest position relative to end wall 14, chamber 34 is at its smallest volume, although volume of chamber of 36 is greatest. In FIG. 3, the rollers have progressed by rolling in the direction of end wall 12 from opposite wall 14. Accordingly, as the volume of chamber 36 is decreased, the volume of chamber 34 on the opposite side of the rollers is increased. Moreover, because of the continuous rolling seal between both of the cylinders, as well as between each cylinder and its adjacent side wall, the volume of gas or other composition in chamber 36 becomes compressed, while the composition in chamber 34 is expanded. In FIG. 4, the cylinders have arrived at the nearest position relative to end wall 12, exactly opposite of their position illustrated in FIG. 2. Accordingly, the volume in chamber 36 has been reduced to minimum while that of 34 is at its maximum. FIG. 5 illustrates the cylinders at approximately their midpoint in return to the extreme position shown in FIG. 2. Thus, the volumes of the two chambers in FIGS. 3 and 5 are substantially identical, with the cylinders being at this same position in both FIGS.

In the examples illustrated in FIGS. 2–5, the different crank arm positions have been rotated successively 90°. Moreover, the direction of the cylinders is reversed as they travel between the two extreme positions shown in FIGS. 2 and 4. Thus, in the examples illustrated, roller 18 will rotate counter clockwise as viewed while roller 16 rotates clockwise, the two rollers travelling at identical or substantially identical rates. This direction of rotation is indicated in FIG. 3 by the directional arrows on each cylinder. Once the position of the cylinders shown in FIG. 4 is reached, i.e., where they are nearest to end wall 12, the rotational direction is immediately reversed, and cylinder 18 rotates clockwise and cylinder 16 counterclockwise as indicated in FIG. 5.

In the apparatus, in order for the cylinders to maintain continuous rolling contact with the sides, the side interior surfaces must be parallel, and each cylinder having a uniform diameter along its entire cylindrical length. The cylinders are also preferably of the same length so that the seal between the cylinders runs the full length of each cylinder. Moreover, the center of each cylindrical roller, i.e., the axis about which each roller rotates, lies along a plane which is perpendicular or normal to the plane of the parallel side walls 20 and 22. In order to provide a complete seal of the chambers in the apparatus, it is necessary that a top and bottom panel be provided, illustrated as panels 24 and 29 in FIG. 1. These panels are secured to the respective side and end walls, and any seams or joints are filled to provide a complete seal of the chambers interiorly thereof. In addition, these top and bottom plates must be in sealing engagement with the ends of the cylindrical rollers so that as the rollers travel therealong, the seal will be maintained between the two chambers. Further, any means of sealing the top and bottom plates with the roller ends may be used to achieve that purpose.

As previously mentioned, the side walls 20 and 22, which are maintained in continuous contact with the rollers, are preferably adjustable so as to maintain this contact, as well as to urge the rollers together in order to maintain contact between their rolling surfaces. Such an adjustment may be made from time to time, with the side walls having means for such adjustments, or, the walls instead may be permanently biased inwardly against the rollers so that such adjustment is continuous. Any suitable means for biasing or adjusting the walls to meet those requirements may be used, and such means are known to those skilled in the art.

Illustrated in FIG. 1 is a crank means for driving or rotating the cylinders or which are driven by the cylinders where an expensive force occurs in the chambers. Only a portion of the crank apparatus is illustrated in which a crank arm 28 is journaled into a crank arm eccentric mounting 30 supported by bearing means, not shown, and free to revolve within each cylinder. The crank arm eccentric mounting and cylinder share common axes of rotation or centers. Rotation of crankshaft 26 causes crank arm 28 to turn within the crank arm eccentric mounting and force the mounting to rotate within the cylinder. Each cylinder moves until it reaches the end of the crank means throw at which time its motion is reversed. This drive results in continuous reciprocating movement in which the two cylindrical rollers, in firm rolling contact with each other and with the interior side walls, cooperate in forming a cavity of regularly increasing and diminishing size on at least one side of the apparatus.

Syncronization of the crank shafts is accomplished by gear means external to the housing or jacket. It will be noted that each of the rollers includes a crank means, and the crankshafts extend through the housing to appropriate power and drive assemblies. Moreover, the crank drive means may be present on one or both sides of each of the cylinders, as desired. The top plate or cover 24 will be provided with an opening through which the crankshaft or a crankshaft extension will project, and with appropriate sealing means associated with the roller ends. The plate may incorporate suitable bearings to reduce friction with the rotating crankshaft as well as to maintain the shaft firmly in position for rotation. Where other means of driving the rollers are used such as eccentric drive means exteriorly of the housing or jacket, slots through which the roller axles will extend may also be provided in the top wall for reciprocating travel of the respective axles. Moreover, any of the housing walls or plates will also be provided with parts for valve means, not shown, to allow injection of gases or fluids into the chambers at desired volumes. Further, when the apparatus is used for igniting combustible and gaseous or fuel mixtures, the forces of expansion will cause the cylinders to roll along their respective paths thus transferring motion through the crank arm eccentric mounting, crank arm, crankshaft, and gear means. Such a device, when properly assembled for use as a internal combustion engine including spark ignition means and the like, may be used for conventional fuel or other power drive means. The apparatus may be used instead as a pumping or compressor device, where power is applied to rotate the crank shafts, and valving means will be incorporated to allow gas or liquids to enter the chambers at maximum volume become compressed, and exit at minimum volume through port 17 in wall 14.

Although the apparatus in FIGS. 1–5 has been referred to as being oriented with plates 24 and 29 being top and bottom plates of the jacket or housing, respectively, the apparatus is not to be so limited. For example, the rollers may rotate along horizontal axes rather than vertical, if desired, or any other angle. Thus, the views of FIGS. 2–5 may be side elevational views, with the concept and operation of the apparatus being substantially identical, regardless of how the cylindrical rollers or the jacket or housing are oriented. This same orientation applies to the remaining embodiments and apparatus described herein and within the purview of the invention.

Figure 6:
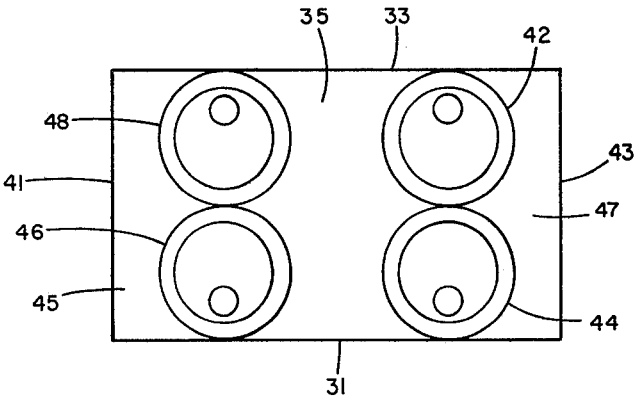
FIG. 6 is a top plan view of two pairs of cylindrical rollers combined to form multiple expanding and contracting chambers.

FIG. 6 illustrates another embodiment at which two pairs of rollers are utilized. In the apparatus schematically shown, a first pair of rollers 42 and 44, and a second pair of rollers 46 and 48 are positioned in a housing or jacket 36, which jacket is entirely enclosed on all six sides, with sides 31 and 33 being parallel, and preferably adjustable in order to compensate for any roller wear. Moreover, as previously explained, these sides are in continuous engagement with the adjacent rollers. The sides also are sealingly secured to end walls 41 and 43, with the top and bottom plates, which are also parallel, required to form sealed chambers 45 and 47. The first pair of rollers comprising rollers 42 and 44 will reciprocate toward and from end wall 43 thereby causing alternate compression and expansion of chamber 47. Similarily, a second pair of rollers comprising rollers 46 and 48 will reciprocate in the direction of and away from wall 41 to alternately cause compression and expansion of chamber 45.

The crank drive means previously explained regarding FIG. 1 may be incorporated into the respective pairs of rollers in this embodiment, or other drive means may be used for driving or recovering driving force from the rollers. Where the crank means for driving or recovering roller energy as previously explained, utilizing the journaled crank arm and crank arm eccentric mounting are used, each pair of cylinders may be driven in the same direction simultaneously, in which chamber 45 will become compressed or reduced as chamber 47 is being expanded. The rollers may be driven to precisely syncronize these movements so that each pair of rollers reaches the end of their respective travel in the same direction at precisely the same instant. On the other hand, it may be desirable to achieve some other volume relationship between the two chambers so that some other syncronized or even a different chamber volume relationship may be achieved as desired.

It will be understood that where the roller movement is such that the pairs of rollers are syncronized for movement in the same direction, the overall length of the jacket in which the chamber is located is not so critical, because there will be no chance that the rollers of different pairs will meet. On the other hand, the apparatus may be used and designed so that each pair of rollers will move in opposite directions at the same time, whereby roller pair (42 and 44) will be moving toward a center of the jacket at the same time and at the same rate as roller pair (46 and 48). In such a design, with the rollers properly syncronized by suitable gearing means cooperating with the crank means, chambers 45 and 47 will expand and contract at the same rate, having precisely the same volumes at the same instant. Such an embodiment may be preferred where double compression and expansion capacities are desired. Moreover, utilizing this same embodiment, a third chamber 35 may be utilized which also is alternately expanded and contracted by reciprocating roller movement. It will be evident that in the opposite roller movement just described, as the chambers 45 and 47 are expanding, chamber 35 will be compressing and visa-versa. Thus, this latter embodiment may be used to take advantage of the third chamber. Such an embodiment will require that the jacket in which the roller pairs operate be of a sufficient length so that as opposing rollers of the respective pairs are at their closest position near the center of the third chamber 35, they do not make contact, although they may approach one another very closely. Again, to take advantage of the full utilization of the third alternately expanding and contracting chamber 35, roller synchronization must be precise as previously explained.

Figure 7:
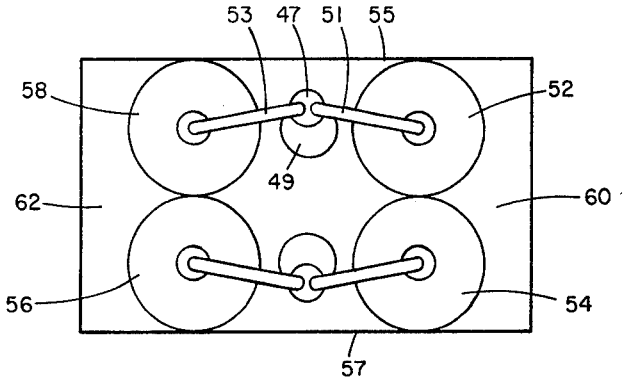
FIG. 7 illustrates another embodiment utilizing two pairs of rollers.

FIG. 7 illustrates a two roller pair embodiment similar to that illustrated in FIG. 6, except that the pairs of rollers are driven reciprocally in the same direction, and at the same rate. For this purpose, crankshaft 49 and eccentric crank arm 47 thereon drive pivotally attached drive rods 51 and 53, each one being pivotally secured to a different roller. Preferably, these drive rods are secured to roller axles, so that as the crankshaft and arm rotate, the drive rods 51 and 53 alternately pull and push the rollers causing reciprocal movement of rollers 52 and 58 of the different pairs. A similar arrangement causes reciprocal motion in the same direction and at the precise same time of rollers 54 and 56. In other words, the crankshaft and arm for both the upper and lower rollers shown will be synchronized so that the axes of the pair of rollers 52 and 54 will lie along a single plane perpendicular with parallel side walls 55 and 57. The same synchronized movement will also be realized with rollers 56 and 58. Accordingly, such movement result in substantially identical expansion and contraction of chambers 60 and 62 at the same time.

In the drive means illustrated for the apparatus of FIG. 7 the axles around which each cylindrical roller rotates, and which axles are parallel, will extend through elongated slots formed in top and bottom covers or end plates, and in sealing and bearing engagement therein. In this figure, such a plate through which the axles of each roller will extend has been removed for viewing the apparatus as illustrated, but slots formed therein will accommodate the axles for the rollers which are driven by drive rods 51 and 53, as well as those for rollers 54 and 56 as described and shown.

Figure 8:
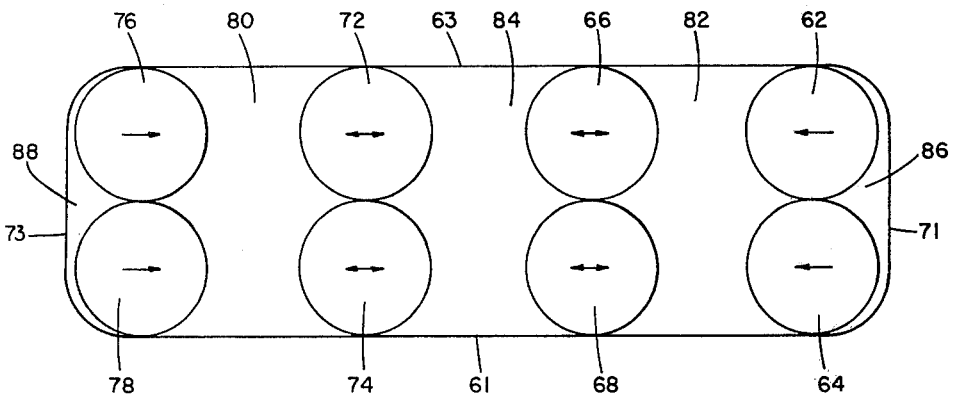
FIG. 8 illustrates another embodiment utilizing a plurality of pairs of rollers and having a plurality of expanding and contracting chambers.

FIG. 8 shows another alternative embodiment of the apparatus incorporating the inventive concept previously described. In the apparatus shown, four pairs of rollers are assembled, each pair of rollers rotating on or about axles which, when aligned for the respective roller pairs extend normal to or 90° with respect to parallel side walls 61 and 63. The different pairs of rollers may be synchronized in different manners, but perferably may utilize or take advantage of five chambers 86, 82, 84, 80 and 88. Chamber 86 may be alternately expanded and contracted as may opposing chamber 82 as roller pairs 62 and 64 reciprocate. Full advantage of such an assembly may be achieved with the pair of rollers 62 and 64 moving at the same rate but oppositely of roller pairs 66 and 68 so that chamber 82 will be fully expanded and contracted by such opposite roller pair movement. Similarly, roller pair 76 and 78 may move at the same rate but precisely oppositely from roller pair 72 and 74 whereby chamber 80 is alternately expanded and contracted. Further, with proper roller pair reciprocal synchronization, chamber 84 may be fully utilized, so that roller pair 72 and 74 will move precisely oppositely from roller pair 66 and 68. As this occurs, chambers 88 and 86 will be expanded and contracted, at the same time and at the same rate and as chambers 86, 88, and 84 are fully expanded, chambers 80 and 82 are fully compressed, and vice versa. It will be evident from this example, that in addition to one and two pairs of rollers, as previously described, any multiples thereof may be used within the purview of the invention to achieve the desired number of expanding and contracting chambers, in any single or multiple apparatus, and the invention is not limited to the specific numbers of pairs of cylindrical rollers and chambers shown.

Figure 9:
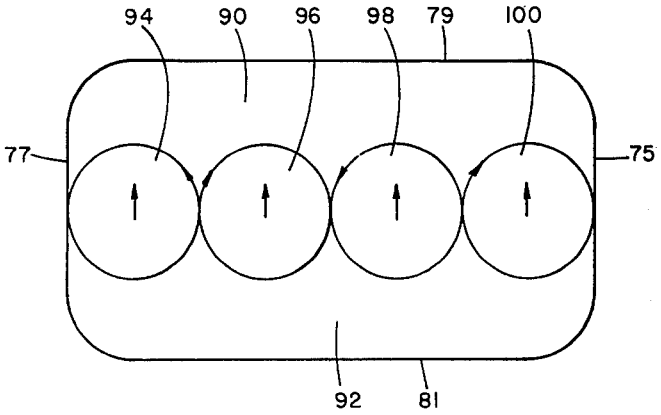
FIG. 9 is a top plan view of cylindrical rollers illustrating still another embodiment having multiple rollers disposed between two opposed walls and in continuous rolling engagement with an adjacent roller and two end walls to form a pair of chambers.

FIG. 9 illustrates a different embodiment utilizing pairs of rollers, in this instance the pairs being stacked or aligned so that each roller rotates about an axis along a single common plane, and which plane is perpendicular to the end plates along which the end rollers are maintained in rolling engagement. Thus, in the embodiment shown, rollers 94, 96, 98, and 100 are aligned with all of their axes being aligned along a single plane, which extends perpendicular to side walls or plates 77 and 75. End plates 79 and 81 cooperate with the side walls to enclose chambers 90 and 92, which are alternately expanded and contracted as the four rollers reciprocate together alternately toward and away from one of the end walls, 79 or 81. Moreover, end roller 94 is in continuous rolling engagement with end wall 77 along the entire roller length, while end roller 100 is similarly in continuous rolling engagement or contact with end wall 75. Each of the rollers is also in continuous rolling contact along its entire length with the adjacent roller or rollers, assuming all of the cylindrical rollers are of the same length, as they are in the preferred embodiment. This rolling contact between the rollers and end rollers with the side walls forms a continuous seal to take advantage of the contracting and expanding chambers. The direction of the different roller rotation is illustrated by the arrows shown on the roller peripheral surfaces for roller directional movement illustrated by the arrows in the center of the rollers. It will be evident that adjacent and contacting rollers will rotate in opposite directions, with the two end rollers 94 and 100 also rotating oppositely, but being driven along the same direction relative to the two opposing side walls 75 and 77. Although this embodiment illustrates multiples of two pairs of rollers aligned, any number of such pairs of rollers may be used, so long as the total number of rollers so aligned is an even number. Moreover, any suitable means may be used for driving the rollers, or for taking advantage of their movement which is translated into work where the rollers are driven by steam, as in a Rankine engine, hot gas, as in a Stirling engine, or by the commonly used ignition of combustible gases. Such means include those previously and hereafter illustrated, as well as other means, known to those skilled in the art to achieve the equivalent function. Again, such drive or energy utilizing menas may be primarily internal or external or combinations thereof from the sealed jacket.

Figure 10:
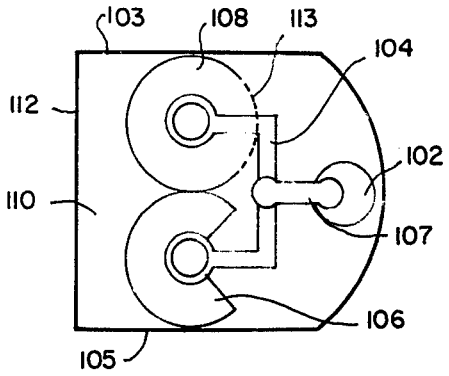
FIG. 10 illustrates an embodiment utilizing cylindrical roller segments, and a means for driving the rollers.

FIG. 10 illustrates an embodiment of a pair of rollers in which one of the roller bodies is a cylinder segment, while the other roller is slotted. A purpose of such an embodiment is to illustrate that where the cylindrical roller surface is not entirely utilized for rolling contact with an adjacent roller and jacket interior wall, only a portion of a cylinder roller may be used, so long as the remaining cylindrical surface segment is sufficient to provide rolling contact. In other words, where the travel of the rollers is not such as to require rolling engagement of an entire circumferential surface, a segmented roller 106 may be used, which will further reduce the overall weight or mass of the roller and apparatus. Roller 108 is hollow and slotted to accomodate arm 104. The roller surface thus is provided with a slot 113, indicated by the dotted line, the length of the slot being sufficient to avoid roller interference with the arm during operation. Thus, the rollers need not be solid, but may be hollow, so long as sufficient structure is present to not interfere with, or detract from the efficiency of the apparatus operation.

Another feature of the embodiment illustrated in FIG. 10 is that only a single chamber is utilized, thereby requiring only a single end wall opposite the rollers for defining and closing the chamber, rather than the pair of walls defining and closing a pair of opposed chambers as previously described. In the embodiment shown, end wall 112 is sealed and secured to parallel side walls 103 and 105, which side walls are preferably adjustable so as to maintain contact against the adjacent roller surfaces and to maintain roller contact. A single alternately expanding and contracting chamber 110 is sealed between the two roller segments, the side walls and end wall, the top and bottom end plates not being illustrated but being understood. The means for driving the pair of roller segments 106 and 108 is a crankshaft 102 having a drive shaft 107 eccentrically and pivotally secured thereon, so that rotation of the crank 102 causes reciprocal movement of the drive shaft. The opposite drive shaft end is pivotally secured to a connecting arm 104, which is secured to the axles of the different cylinder segments. Thus, rotation of drive plate 102 causes reciprocal movement of the roller segments toward and away from end wall 112. If the apparatus illustrated is used, the cylinder segments are driven where a gas is expanded within chamber 110, the resulting work for driving cranksfaft 102 may be utilized. The crankshaft, connecting arms and rods illustrated may be housed within the apparatus housing, or it may be exteriorly mounted. Again, the roller segment embodiment may be used for modification of any of the previously described cylindrical roller assemblies, where weight reduction is desired. Moreover, the previously described roller pair apparatus of FIGS. 1–5 may utilize only a single chamber embodiment where opposing sealed chambers are not required or desired.

Figure 11:
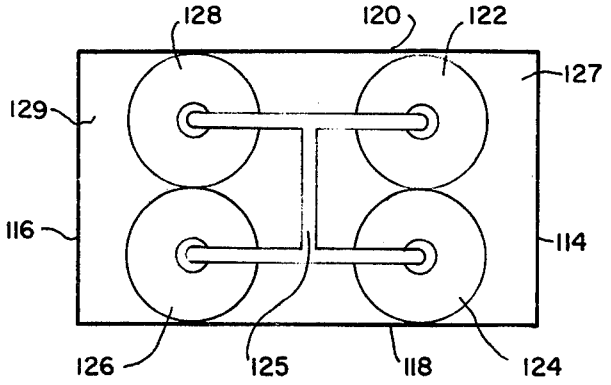
FIG. 11 illustrates an embodiment utilizing two pairs of rollers and another form of drive means.

FIG. 11 shows still another embodiment of the roller pair apparatus in which a rigid structural support 125 is secured to each of the roller axles. With such a device, the rollers all move in the same direction at precisely the same time, resulting in chamber 127 being contracted while chamber 129 is being expanded, and vice versa. Again, according to the requirements of the invention, each roller of each pair is in rolling and sealing contact with the other roller of that pair, and in rolling and sealing contact with one of the parallel side walls. Thus, rollers 122 and 128 are in rolling contact with side wall 120, while roller 124 and 126 are in sealing and rolling contact with side wall 118, which side wall is parallel with side wall 120. The sealed housing structure is completed with walls 114 and 118, and end walls, not shown, covering the roller ends and in sealing engagment therewith. Such end walls are provided with slots for movement of the roller axles or extensions which are attached to the support 125.

Figure 12:
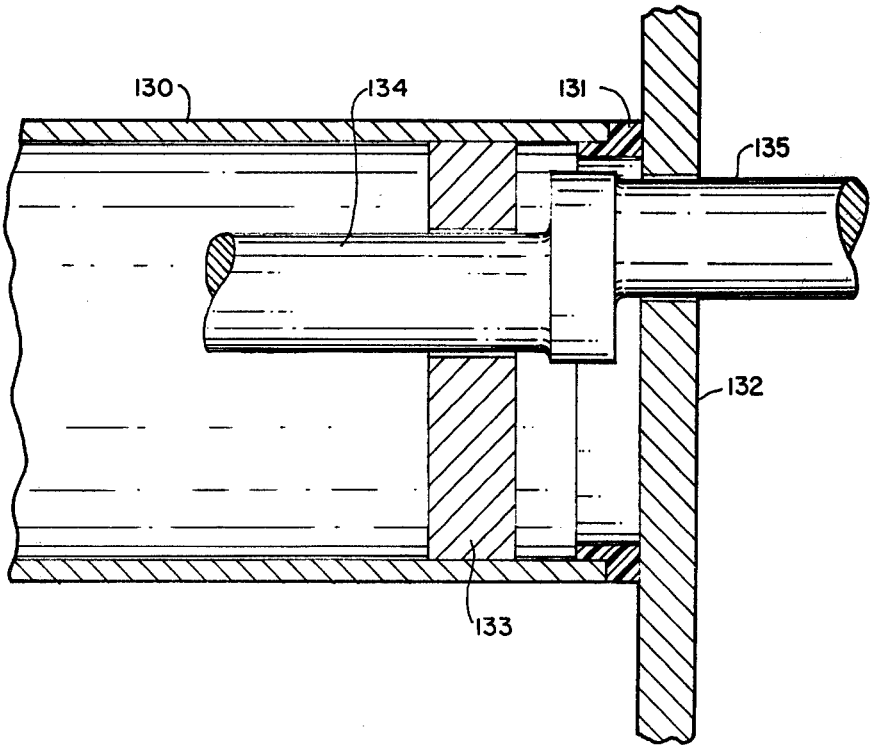
FIG. 12 is a partial sectional elevation showing roller sealing means.

FIG. 12 illustrates a means for sealing the roller ends with the end panels or plates as previously noted. In the example illustrated, the roller 130 is hollow, and has a recessed end plate 133 into which a crank arm 134 is journaled. At the cylinder end is secured a sealing ring 131, which ring engages the exposed interior surface of end plate 132 thereby sealing off the cavity. As the roller is rotated, the sealing ring continuously engages the polished interior end plate surface, as the roller moves eccentrically or reciprocally as previously described. Crank shaft 135 extends through an opening 136 in end wall 132 which opening is of a size sufficient to allow the movement of the crank arm as crank shaft 135 is rotated.

The material of the rollers may be rigid including metal or rigid plastics, or may be more flexible such as flexible and compressible plastics or elastomers. The specific material comprising the rollers will depend on the use of the apparatus, the material requirements being only such that the rollers will function properly and adequately to maintain the rolling seals, with the specific material being selected to meet the necessary functional apparatus requirements including friction reduction and wear resistance, since the seals will be in continuous sliding engagement with the interior end plate surface. The apparatus may be provided with passageways or ports in the walls whereby fluids may be introduced into and removed from the chamber.

These ports may be positioned for exposure to the chamber in desired roller positions, especially utilizing the eccentric or reciprocal rollers for alternately opening or closing the ports as the rollers cover and uncover the ports with respect to the chamber. Accordingly, such ports may be advantageously positioned whether the apparatus is to be used in a four or two cycle combustion chamber process, or whether other fluids are simply introduced and expanded or compressed by the apparatus.

The orientation of the rollers in the apparatus is not particularly critical, unless specific use requirements dictate such orientation. Thus, for example, the rollers may rotate along horizontal or vertical axes, or any other angle. Accordingly, the views shown may be side elevational views or top plan views, with the concept of and operation of the apparatus otherwise being substantially identical, regardless of how the cylindrical rollers or the housing or end plates are oriented. Although the drawings show substantially similar roller diameters, such a limitation is not critical. Instead, the rollers in an apparatus may be of different diameters, so long as each roller has a uniform diameter.

The advantages of the apparatus of the invention, as previously explained, include the obviation of lubrication of wall surfaces surrounding the expanding and contracting chambers because of the rolling action of the rollers which produce minimum friction. Moreover, combustion chamber sizes are easily adjusted to create desired power output, and the components are readily interchangeable. Engine torque may be determined by the location and dimension of a single part, i.e., the eccentric power output shaft, and forces of combustion are distributed over a large and changing area of cylinder walls and through a multiplicity of shafts and connecting arm bearings, rather than through one piston, one wrist pin bearing and a single crankshaft bearing. Moreover, rotating parts which form the working chamber in an internal combustion or heat engine embodiment are exposed to a cooling medium over most of the cylinder wall surfaces during each revolution. Thus, only a portion of the cylinder or roller walls are exposed to the heat and forces continually throughout the entire cycle since the heated roller areas are continually proceeding to a cooling medium. As use results in engine wear, adjustment of the parallel side walls will maintain seal integrity without disassembly of major engine components. Moreover, continued operation may cause the common roller surfaces to machine themselves to a progressively more compatible fit. Because of the lightweight and low mechanical mass of reciprocating parts (rollers), higher rotational speeds are possible. Further, the chamber sizes may be adjusted by simply varying dimensions of the eccentric roller crank or by the insertion or deletion of volume reducing members which occupy unused chamber volume. Additional advantages include the possibility of large chambers created with only a small movement of a crank means, a minimum number of moving parts, and whereby cooling or lubricating means is easily introduced into the cylinder interior through crankshafts. Such apparatus within the invention described herein is inexpensive to manufacture, is adjustable for wear by external means even while the apparatus is in operation, and is easily arranged in multiple chambers for concerted operation and balanced movement. These as well as other advantages and equivalent embodiments within the purview of the invention as described herein will be evident to those skilled in the art.

I claim:

1. An apparatus having an alternately expanding and contracting chamber comprising:

at least one pair of cylindrical rollers each having an exterior surface in continuous rolling engagement with the surface of the other roller of said pair, said rollers being rotatable along parallel axes;

said chamber having defined between first and second parallel side walls, at least one end wall spaced from said rollers and top and bottom plates;

said rollers being in continuous rolling contact with said side walls, and in end sealing relationship with said top and bottom plates.

2. The apparatus of claim 1 wherein different rollers of said pair of rollers are in rolling contact with opposite side walls, respectively.

3. The apparatus of claim 1 including a second end wall spaced from said rollers; whereby a first chamber is defined between said rollers and said one end wall, and a second chamber is defined between said rollers and said second end wall.

4. The apparatus of claim 1 wherein said rollers comprises elongated cylindrical segments.

5. The apparatus of claim 1 including drive means for rotating said rollers.

6. The apparatus of claim 1 comprising one pair of rollers and wherein one roller of said pair is in rolling contact with said first side wall and the other roller is in rolling contact with said second side wall.

7. The apparatus of claim 6 including a crank arm eccentric mounting rotatably secured in one end of each of said rollers, a crank arm journaled into said mounting, and a crankshaft for driving said crank arm.

8. The apparatus of claim 6 wherein said rollers are elongated, have substantially equal lengths, and are in rolling contact with each other substantially along their entire respective lengths.

9. The apparatus of claim 8 wherein said rollers have substantially equal diameters.

10. The apparatus of claim 1 including crank means cooperating with said rollers for imparting rotation thereto.

11. The apparatus of claim 10 wherein said crank means comprises a crankshaft, crank, and a pair of connecting arms each secured to one of said rollers.

12. The apparatus of claim 1 comprising two pairs of said rollers, each pair having a first roller in rolling contact with the first side wall and a second roller in rolling contact with the second side wall.

13. The apparatus of claim 12 including a second end wall spaced from said rollers; a first chamber being defined between one pair of rollers and said first end wall and a second chamber is defined between the other pair of rollers and said second end wall.

14. The apparatus of claim 13 including means for rotating said pairs of rollers simultaneously in the same direction.

15. The apparatus of claim 13 including means for rotating said pairs of rollers simultaneously in opposite directions, whereby a third alternately expanding and contracting chamber is defined between said pairs of rollers.

16. The apparatus of claim 13 including crank means cooperating with said rollers for imparting rotation thereof.

17. The apparatus of claim 16 wherein said crank means comprises a crank arm eccentric mounting rotatably secured in one end of each said rollers, a crank arm journaled into said mounting, and a crankshaft for driving said crank arm.

18. The apparatus of claim 16 wherein said crank means comprises a pair of cranks, a pair of connecting rods driven by each crank, each rod pivotally connected to a different one of said rollers.

19. An apparatus having an alternately expanding and contracting chamber comprising a plurality of four or more even numbered cylindrical rollers rotatable about an axis, each having an exterior surface in rolling engagement with the surface of an adjacent roller, said rollers being aligned whereby the respective roller axes lie along a single plane, first and second parallel side walls, a roller at each end of said plurality of rollers being in rolling contact with said side walls, and an end wall spaced from said rollers, whereby said chamber is defined between said rollers said walls and top and bottom plates, said top and bottom plates sealingly engaging respective ends at said rollers.

20. The apparatus of claim 19 including a second end wall spaced from said rollers, whereby a first chamber is defined between said rollers and said first end wall, and a second chamber is defined between said rollers and said second end wall.

21. The apparatus of claim 19 including drive means for rotating said rollers.

22. An apparatus having an alternately expanding and contracting chamber comprising a pair of cylindrical rollers each having an exterior surface in continuous rolling engagement with the surface of the other roller of said pair, said rollers being rotatable along parallel axes, said rollers being disposed in a chamber housing defined internally between first and second parallel side walls, wherein one roller of said pair of rollers is in rolling engagement with said first side wall and the other roller of said pair is in rolling engagement with said second side wall, a third wall joining said first and second side walls, said third wall being spaced from said rollers, a pair of opposed end plates for enclosing said chamber and in sealing engagement with said first, second and third walls and said rollers, and means for coupling said rollers to the exterior of said chamber whereby rotational movement of said rollers is coupled to the exterior of said chamber.

23. The apparatus of claim 22 including means for coupling said pair of rollers in rotatably move simultaneously in the same direction.

24. The apparatus of claim 22 including crank means cooperating with said rollers for imparting rotation thereto, wherein said crank means includes at least one crankshaft journaled into at least one of said chamber walls or extension thereof, and wherein said crankshaft and at least one of said rollers are connected by crank arm and connecting link means.

25. The apparatus of claim 22 including at least one opening communicating with the interior of said chamber for permitting entrance or exit of substances or fluids to or from said chamber.

26. The apparatus of claim 22 wherein at least one of said rollers comprises an elongated cylindrical segment with a discontinuous exterior surface of equal radius wherein one roller of said pair of rollers is in rolling engagement with said first side wall, and the other roller of said pair is in rolling engagement with said second side wall, and wherein said rollers are in rolling engagement with each other.

27. The apparatus of claim 22 including a fourth wall joining said first and second side walls, said fourth wall being spaced from said rollers whereby a first chamber is defined between said third wall, said pair of rollers, said side walls and said end plates, and a second chamber is defined between said fourth wall, said pair of rollers, said side walls and said end plates.

28. The apparatus of claim 27 including two pairs of said rollers, each pair having a first roller in rolling engagement with the first said side wall and a second roller in rolling engagement with the second side wall, wherein a first chamber is defined between said third wall, said first pair of rollers, said side walls and said end plates, a second chamber is defined between said first pair of rollers and said second pair of rollers, said side walls and said end plates, and a third chamber is defined between said second pair of rollers, said fourth wall, said side walls and said end plates.

29. The apparatus of claim 28 including means for causing said pairs of rollers to rotatably move simultaneously in opposite directions, whereby an alternately expanding and contracting said second chamber is defined between said pairs of rollers.

30. The apparatus of claim 28 including crank means cooperating with said pairs of rollers for imparting rotation thereto, wherein said crank means includes at least one crankshaft journaled into at least one of said chamber walls, and wherein said crankshaft and at least one roller of each said pair of rollers are connected by crank arm and connecting link means.

31. The combination in accordance with claim 22 wherein at least one of said rollers is hollow and includes end seals in sealing contact with a respective end plate, crank means journaled through at least one of said end plates, extending through one of said seals and coupled to said roller for transmitting rotational movement between said roller and the exterior of said chambers.

32. The combination in accordance with claim 31 wherein said end seals comprise rings engaging the end of said rollers and at least one of said rings encircles said crank means to provide sealing at said crank from said chamber in addition to sealing said rollers with respect to said chamber.

33. An apparatus having an alternately expanding and contracting chamber comprising a plurality of four or more even numbered cylindrical rollers rotatable about an axis, each having an exterior surface in rolling engagement with the surface of an adjacent roller, said rollers being aligned whereby the respective roller axes lie along a single plane, first and second parallel side walls, a roller at each end of said plurality of rollers being in rolling engagement with a different one of said side walls, a third wall joining said first and second side walls, said third wall being spaced from said rollers, a pair of opposed end plates for enclosing said chamber and sealingly engaging said third wall, said first and second side walls and said rollers, whereby said chamber is defined internally between said rollers, said walls and said end plates, and means for causing said plurality of rollers to rotatably move simultaneously toward or away from said third wall.

34. The apparatus of claim 33 including a fourth wall joining said first and second side walls, said fourth wall being spaced from said rollers whereby a first chamber is defined between said third wall, said rollers, said side walls and said end plates, and a second chamber is defined between said fourth wall, said rollers, said side walls and said endplates.

35. The combination in accordance with claim 33 including means coupling said plurality of four or more even numbered cylindrical rollers for simultaneous longitudinal movement toward or away from said third and fourth walls.

36. The apparatus of claim 33 including at least one opening communicating with said chamber for permitting entrance or exit of substances or fluids to or from said chamber.

37. The apparatus of claim 33 wherein at least one roller of said plurality of rollers comprises an elongated cylindrical segment with a discontinuous exterior surface of equal radius wherein said roller is in rolling engagement with at least one other roller of said plurality of rollers, and in rolling engagement with a second roller of said plurality of rollers or a respective side wall.

* * * * *